United States Patent [19]

Ray, Jr.

[11] 4,013,407

[45] Mar. 22, 1977

[54] BACK DYEING, TUFTING, AND HOT AIR SUBLIMATION OF DYES TO PILE OF CARPETS

[75] Inventor: Leonard N. Ray, Jr., Lancaster, Pa.

[73] Assignee: Armstrong Cork Company, Lancaster, Pa.

[22] Filed: Sept. 12, 1975

[21] Appl. No.: 612,772

[52] U.S. Cl. ..... 8/17; 8/62; 8/1 XB; 8/2.5 A; 28/72.2 R; 428/95

[51] Int. Cl.[2] ..... D06P 7/00

[58] Field of Search ..... 8/2.5 A, 2.5 R, 1 XB, 8/17, 62

[56] References Cited

UNITED STATES PATENTS

| | | | |
|---|---|---|---|
| 2,068,770 | 1/1937 | Schwarzschell | 8/14 X |
| 3,758,269 | 9/1973 | Bartsch | 8/1 X |
| 3,837,796 | 9/1974 | Flexssner | 8/21 R |
| 3,874,846 | 4/1975 | Ashe | 8/2.5 |
| 3,880,579 | 4/1975 | Renaut | 8/2.5 |
| 3,949,574 | 4/1976 | Glover | 8/5 |

OTHER PUBLICATIONS

Ciba Review, Jan. 1967, pp. 47–51 and 1970, pp. 53–55.

*Primary Examiner*—Donald Levy

[57] ABSTRACT

A pattern is placed on one surface of a carpet backing by the use of sublimable dyes. A carpet facing is tufted into the backing with the face yarns on the side of the backing opposite from the side of the backing containing the pattern of dyes. Subsequent heating causes the sublimable dyes to move from the carpet backing surface through the carpet backing and then through the face yarn to provide a dyed patterned face yarn. A latex coating is provided to the carpet backing to lock the tufted carpet face yarns to the carpet backing and to lock residual dye to the surface of the carpet backing.

5 Claims, 1 Drawing Figure

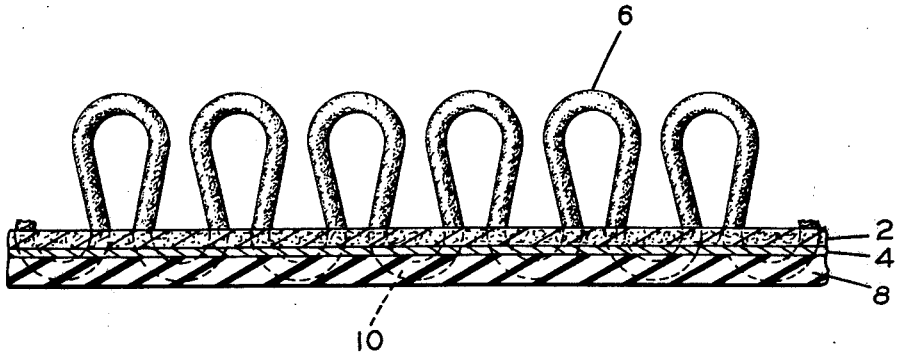
6
2
4
8
10

BACK DYEING, TUFTING, AND HOT AIR SUBLIMATION OF DYES TO PILE OF CARPETS

CROSS-REFERENCE TO RELATED APPLICATIONS

This application is directed to an improvement over the application of Robert W. Snyder, entitled "Product and Method of Printing Carpet", which was filed Sept. 12, 1975 as application Ser. No. 612,907.

BACKGROUND OF THE INVENTION

1. Field of the Invention

The invention is primarily directed to a technique for printing carpet, and more particularly, to a printing technique that uses sublimable dyes and uses the carpet backing as the transfer carrier for the sublimable dyes.

2. Description of the Prior Art

U.S. Pat. No. 3,782,896 discloses it is old to use transfer printing operations to print carpet designs.

Transfer printing through the use of sublimable dyes is an old art. Normally, the dye is carried on a transfer carrier or sheet and the transfer carrier is placed up against the surface to be dyed. Through the use of heat and pressure, the sublimable dyes are converted to a vapor stage and transferred to the surface of a material adjacent the transfer carrier. The transfer carrier is then usually discarded. When one would attempt to transfer print heavy fabrics, such as carpet, then vacuum action would be required to attempt to secure some dye penetration into the fabric.

The inventive technique herein is the utilization of the transfer carrier as a portion of the finished product. Herein, specifically, the transfer carrier is used as the conventional backing for a carpet product that has tufted thereinto the carpet face yarns which will be subsequently dyed by the sublimable dyes on the transfer carrier. The design printed on the conventional backing is on the side of the backing opposite from the carpet face yarns so that the conventional latex coating, which is normally applied to a tufted carpet, will lock the residual dyes on the carpet backing to the carpet backing.

SUMMARY OF THE INVENTION

A conventional carpet backing is provided with a pattern printed thereon through the use of inks containing sublimable dyes. After the inks have had an opportunity to dry, conventional yarn is tufted into the carpet backing to form the ultimate carpet product composed of a backing and a tufted face yarn. The ultimate carpet product is made with the tufted face yarn placed on the side of the carpet backing opposite from the side of the carpet backing which contains the printed pattern. Heated air is then passed through the carpet in the direction from the backing to the face yarn. This causes the sublimable dyes to change to a vapor phase and to be transferred through the carpet backing and deposited on the carpet face yarns. There then results a product which is composed of a carpet backing and face fiber yarns containing a decorative pattern thereon. At this time, a coating is placed upon the back of the carpet, that is, the side of the carpet backing containing the printed pattern, so as to lock in the excess residual dyes on the back side of the carpet backing and, at the same time, to lock the tufted carpet yarn to the backing of the carpet.

BRIEF DESCRIPTION OF THE DRAWING

The FIGURE of the drawing is a cross-sectional view of the product of the invention herein.

DESCRIPTION OF THE PREFERRED EMBODIMENT

The process herein is carried out by basically the following steps. A conventional carpet backing or scrim material, which is porous in nature, is provided with a design printed thereon by a conventional Zimmer printer, utilizing inks containing sublimable dyes. Printing can be carried out by any commercially available printer as long as it places the different dyes in position in register. The printed carpet backing is then permitted to air dry. A conventional carpet yarn is tufted into the carpet backing by conventional tufting machinery. The piles or loops or face fiber yarns of the finished tufted yarn product will be on the opposite side of the carpet backing from the printed design containing sublimable dyes. The carpet backing with the tufted yarns is then subjected to a heated air treatment wherein air is passed through the carpet in the direction from the backing of the carpet through to the face fiber yarns of the carpet. At this time, the pattern printed on the back side of the carpet backing is transferred from the carpet backing and fully developed throughout the height of the pile of the face yarns. There is then provided a carpet product which has a backing and yarn tufted into the face thereof with the yarn being dyed in a selected pattern. A latex or other type of coating material is then provided to the back side of the carpet product, this being the side of the carpet backing which contains the printed design, so as to lock in excess or residual dye left over from the printed dyestuffs. The coating also will lock in the tufted fiber yarns so that the tufted fiber yarns cannot be readily separated from the carpet backing. The use of directional heated air provides good pattern definition and depth of dye penetration in the pile of the carpet. Under some circumstances, it might be possible just to apply heat to the carpet product and permit the dyes to migrate from the back of the carpet backing to the carpet face yarns.

In one specific example of the invention, conventional jute carpet backing with a 19 × 19 count is utilized. The 19 × 19 count is the number of yarns in the warp and woof direction. The aforesaid jute weighs approximately 6 ounces per square yard (203 g. per square meter). This material has an air permeability of 650 standard cubic feet per minute per square foot (198 cubic meters per minute per square meter). The jute material is run across a Zimmer printer and printed with conventional inks containing sublimable dyes. Specifically, the dyes being used are Latyl Cerise NSN, C.I. Disperse No. Red 60, C.I. Constitution No. 60756; Latyl Violet 2R, C.I. Disperse No. Violet 28, C.I. Constitution No. 61102; and Acetamine Yellow CG, C.I. Disperse No. Yellow 3, C.I. Constitution No. 11855. The design printed on the jute may be any type of aesthetic design and after it is printed on the jute with the abovesaid sublimable dyes, it is permitted to dry. Nylon 66 yarn, Dupont Type 846, 1300 denier, bulk continuous filament is then tufted into the jute using a 5/64 inch (0.2 cm) gauge, 12 tufts per inch to produce a ⅛ inch (0.3 cm) pile level looped carpet weighing 13 ounces per square yard (441 g. per square meter). The Nylon 66 is tufted into the jute so that the face fiber yarns will be on the side of the jute opposite from the side of the jute containing the printed design. The product so formed will look similar to that shown in the drawing wherein the carpet backing 2 is provided with a design 4 and a tufted yarn 6. The tufted yarns have their pile loop construction on the side of the carpet backing 2 opposite from the side of the carpet backing which has the printed design 4.

The above product is then passed through a chamber wherein air, at 425° F. (218° C.), may be passed through the carpet in the direction from the scrim 2 to the face yarn 6 at a rate of 15 standard cubic feet per minute per square foot (5 cubic meters per minute per square meter) for 3 minutes. In this time, the pattern 4 which was printed on the jute with sublimable dyes is transferred and fully developed throughout the height of the pile 6. The print is brightly colored with a soft, diffused appearance.

The carpet is then provided with a latex tie coat 8. If one were to take hold of a single one of the loops of the face yarn 6 and tub thereon, it would be possible to pull the yarn completely out of the carpet backing because of the nature of the tufting operation that placed the yarn on the carpet backing 2. In order to prevent this, the latex coating is provided on the back of the carpet backing 2 so as to lock in the yarn segments 10 which are on the back of the carpet backing. The latex forms a film across the back of the carpet backing and holds the elements 10 of the tufted carpet yarn in position on the back of the scrim. It now is no longer easy to pull the carpet yarn out from the carpet backing by grasping hold of one of the loops of the face yarn 6 and pulling thereon.

It was noted that in the use of the procedure of the abovementioned application, wherein there is the printing of the dyestuffs on the upper side of the carpet backing, that is, the side of the carpet on which the face fiber piles 6 exist, there is a likelihood of residual or excess dye causing a staining, crocking, or bleeding problem after the carpet is printed and placed in use. By using the technique herein, wherein the printed design 4 is on the back side of the carpet backing 2 away from the face fiber 6 of the carpet, the staining, crocking, and bleeding problems are diminished. The coating 8 on the back of the carpet, which is being placed on the side of the backing 2 which has the design thereon, will lock in excess or residual dye on the underside of the carpet backing so that subsequent actions on the carpet will not permit the residual dye to be released and migrate up into the face fiber pile 6.

An extension of the above concept would involve the printing of the design 4 on the back of the carpet product after the yarn has been tufted into the carpet backing 2. All processing of the carpet and dye transfer are carried out as above set forth with the only variant being the printing of the design on the carpet backing which has the yarn already tufted thereinto rather than the first above-described procedure wherein the design is printed on the carpet backing and then the yarn is tufted thereinto.

In addition to using jute as the backing material, the invention can be carried out using backing materials of glass fiber and woven and non-woven polypropylene. In addition to using Nylon 66 as the carpet face yarn, the invention can be carried out using Nylon 6 and polyester fibers as the carpet face yarn. The invention can be carried out with or without directional heated air. All of the different embodiments and examples set forth in the above-mentioned application may be carried out utilizing the technique of the application herein. All of the backing materials, carpet face yarn, carpet constructions, dyes, air flow characteristics and temperatures may be utilized herein with the only variant being the positioning of the printed design on the back of the carpet backing, that is on the side of the carpet backing opposite from the side of the carpet backing containing the face fiber piles 6.

The only variant in processing that has been noted between the process of the technique herein and the process of the above-mentioned copending application is that there may need to be a slight increase in air flow or a slight increase in processing time since the dyes must pass through the carpet backing before they can then pass through the face fiber yarn. In the above-mentioned patent application, the dyes move directly from the surface of the carpet backing through the face fiber yarns. Herein, because the dyes are on the back side of the backing, the dyes must initially move through the carpet backing and then through the face fiber yarns. This slightly longer path of travel, plus the slight increase in air permeability of the scrim face yarn combination versus just the face yarn structure alone, may require either slightly increased processing time or air flow in order to get the printed design on the face fiber yarns in a brightly colored design with a soft, diffused appearance comparable to the design secured in the above-mentioned copending application.

The latex coating may be applied by conventional roll coating equipment or by other suitable means such as spraying. The application rate generally will be in the range of 5 to 40 ounces per square yard on a dry weight basis. The coating may be dried in conventional ovens, by infra-red heaters, etc. Often it is desirable to incorporate fillers such as calcium carbonate, alumina trihydrate, clays, felspar and other materials in the latex. In the specific example described above, there was applied at a rate of 30 ounces per square yard a carboxylated styrenebutadiene rubber latex (Lotol 520 made by Uniroyal) at 50% solids and containing 300 parts alumina trihydrate and 50 parts limestone per 100 parts latex solids. While the above is a preferred type of latex binder, other compositions such as those disclosed in U.S. Pat. Nos. 3,756,974 may be used.

The inks which normally are used for printing of the backing are prepared as a three-part composition. A thickener is used and it will constitute 80–90 parts by weight of the mix. The disperse dye will constitute 5 to 10 parts of the mix and an accelerator will constitute 0 to 10 parts of the mix. The thickener usually consists of a 3% Chemloid 2245 in water plus 0.1% Dowicide G as preservative. Chemloid 2245 is supplied by the Chemloid Company and is basically a refined natural ether or gum. Dowicide G is produced by the Dow Chemical Company and is basically a monohydrate of sodium pentachlorophenate. The ink is prepared by dissolving the preservative in water, then slowly adding the Chemloid 2245 while using a high shear mixer to mix. The mix is allowed to stand 2 to 4 hours before final mixing and use. If an accelerator is used, it is added and mixed using a high shear mixer. A typical accelerator that may be used is a polyvinyl acetate emulsion. Finally, the dispersed dye or any other appropriate dye is added and mixed for 5 to 10 minutes to produce uniform, smooth ink. In the ink formulation, the amount of dye is varied depending upon the depth of color desired. The accelerators increase the intensity of the color developed with a given amount of dye. The accelerators also have a tendency to reduce the time required to produce a print with a given intensity. With some dyes, it is possible to use a solvent base rather than a water base.

Based upon experimentation to date, it is believed that through the use of the above referred to different scrims, carpet face fibers and dyes, it is possible to make an acceptable commercial product through the use of an air flow rate as low as about 10 standard cubic feet per minute per square foot (3.0 cubic meters per minute per square meter), and preferably 10 to 120 standard cubic feet per minute per square foot (3.0–37 cubic meters per minute per square meter). The transfer can be carried out through the use of different gaseous means which may be heated anywhere in the range of about 260° to 450° F. (127°–232° C.), primarily depending upon the dyes being utilized and the sensitivity of the carpet components to temperature. The time to transfer the dye may take place anywhere from about 30 seconds to 15 minutes, but should preferably occur within a 30-second to 3-minute time span.

What is claimed is:

1. A process for making a decorative carpet through the use of sublimable dyes comprising the steps of:

a. printing sublimable dyes on one side of the carpet backing prior to the time of the carpet face yarns are tufted into the carpet backing, b. tufting the carpet face yarns into the carpet backing with the carpet face yarn pile being on the opposite side of the carpet backing from that side of the carpet backing which contains the sublimable dyes, c. transferring the sublimable dyes from the carpet backing to the carpet face yarn through the application of a heated gaseous medium passing through the carpet from the carpet backing side of the carpet to the carpet face yarn side of the carpet, said heated gaseous medium vaporizes the sublimable dyes on the carpet backing and moves and deposits the dye on the carpet face yarns and d. applying a coating to the back of the carpet backing on that side of the backing which is the side of the carpet backing that had the design printed thereon with sublimable dyes to lock in excess or residual dyes to the back side of the carpet backing.

2. The process according to claim 1 wherein the gaseous medium is supplied at an air flow rate of as low as 10 standard cubic feet per minute per square foot and ranging from preferably about 10 to 120 standard cubic feet per minute per square foot.

3. The process according to claim 1 wherein the gaseous medium is supplied at temperature ranging from about 260° to 450° F. and dye transfer time ranges from about 30 seconds to 15 minutes.

4. A process for making a decorative carpet through the use of sublimable dyes comprising the steps of:

a. printing sublimable dyes on one side of the carpet backing prior to the time the carpet face yarns are tufted into the carpet backing, b. tufting the carpet face yarns into the carpet backing with the carpet face yarn pile being on the opposite side of the carpet backing from that side of the carpet backing which contains the sublimable dyes, c. transferring the sublimable dyes from the carpet backing to the carpet face yarn through the application of heat to the carpet to vaporize the dyes and permit the dyes to transfer to the carpet face yarn, and d. applying a coating to the back of the carpet backing on that side of the backing which is the side of the carpet backing that had the design printed thereon with sublimable dyes to lock in excess or residual dyes to the back side of the carpet backing.

5. The process according to claim 4 wherein the heat supplied is at a temperature ranging from about 260° to 450° F. and dye transfer time ranges from about 30 seconds to 15 minutes.

* * * * *